US007614785B2

(12) United States Patent
Hiranuma et al.

(10) Patent No.: US 7,614,785 B2
(45) Date of Patent: Nov. 10, 2009

(54) TIMEPIECE HAVING ROTATABLE AND DETACHABLE BEZEL

(75) Inventors: Haruki Hiranuma, Chiba (JP); Kazutaka Imai, Chiba (JP); Koremoto Takeda, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 12/221,049

(22) Filed: Jul. 30, 2008

(65) Prior Publication Data

US 2009/0040882 A1 Feb. 12, 2009

(30) Foreign Application Priority Data

Aug. 8, 2007 (JP) ..... 2007-206677

(51) Int. Cl.
*G04B 39/00* (2006.01)

(52) U.S. Cl. ..... 368/295; 368/294

(58) Field of Classification Search ..... 368/294, 368/295

See application file for complete search history.

(56) References Cited

U.S. PATENT DOCUMENTS 6,379,037 B1 * 4/2002 Saleh et al. ..... 368/185
7,137,732 B2 * 11/2006 Takeda ..... 368/295

* cited by examiner

*Primary Examiner*—Truc T Nguyen
*Assistant Examiner*—Jason Collins
(74) *Attorney, Agent, or Firm*—Adams & Wilks

(57) ABSTRACT

A timepiece has a case body and a bezel rotatably and detachably connected to the case body. A ring-shaped guide groove formed in the bezel opposes a ring groove formed in the case body, and a plurality of holding members are slidable in the guide groove into and out of the ring groove to respectively prevent and permit detachment of the bezel from the case body. A plurality of operating screws are screwed into the bezel from an outer side thereof and are rotatably connected at their front end portions to respective holding members. Rotation of the operating screws in tightening and loosening directions moves the holding members into and out of the ring groove.

5 Claims, 7 Drawing Sheets

TIMEPIECE HAVING ROTATABLE AND DETACHABLE BEZEL

BACKGROUND OF THE INVENTION

1. Field of the Invention

The present invention relates to a timepiece of a wristwatch or the like including a rotatable bezel.

2. Related Art

In a background art, there is known a wristwatch attached with a rotary bezel at a case body by rotatably fitting the rotary bezel to the case back by making two projected portions caught by each other such that the projected portions provided at an inner periphery of the rotary bezel rides over the projected portion provided at an outer periphery of a ring-like portion of the case body surrounding a transparent cover covering a time display portion to a lower side (refer to, for example, Patent Reference 1).

Further, there is known a wristwatch in which in order to attach a rotary bezel to a case body without depending on such a catching structure, a ring-like groove is formed at an outer peripheral face of the rotary bezel fitted to an outer periphery of a ring-like portion of the case body, a pair of engaging members arranged on an outer side of the rotary bezel and in 12 o'clock-6 o'clock directions of the wristwatch are detachably screwed to fasten to the case body, projected portions in a circular arc shape provided at the engaging members are engaged to the ring-like groove of the rotary bezel, thereby, the rotary bezel is made to be able to rotate in the engaging state. The case body of the wristwatch is formed with an outer peripheral wall at a portion thereof which is not arranged with the engaging member, and a surrounding of the rotary bezel is covered by the outer peripheral wall such that the ring-like groove of the rotary bezel is not exposed (refer to, for example, Patent Reference 1).

[Patent Reference 1] JP-A-11-118950 (paragraphs 0003-0007, 0020-0038, FIG. 1-FIG. 5)

The technology of the latter is excellent in that a drawback of the technology of the former, that is, a drawback of deforming the case body and the rotary bezel in accordance with prying to detach the rotary bezel in maintenance, can be resolved.

However, there is the following drawback in the technology of the latter. That is, the surrounding of the rotary bezel is covered by the outer peripheral wall of the case body, and therefore, a thickness for the attachment of the finger in operating to rotate the rotary bezel is obliged to be thinned and, thereby, the operability of the rotary bezel is poor. In addition thereto, the operability of the rotary bezel is poor since in operating to rotate the rotary bezel, since rotation is hampered by touching the finger of a user to the pair of engaging members arranged on the outer side of the rotary bezel.

Further, the pair of engaging members screwed to be fastened to the case body are arranged on the outer side of the rotary bezel, and therefore, the engaging members constitute a restriction when the rotary bezel is intended to enlarge from a request in view of design. Therefore, in order to enlarge the rotary bezel, the case back needs to be enlarged inclusively.

It is an object of the invention to provide a timepiece which can attach and detach a rotary bezel without being accompanied by a deformation, and can promote a rotation operability of the rotary bezel and does not bring about large-sized formation of a case body when the rotary bezel is enlarged.

SUMMARY OF THE INVENTION

The invention includes a case body which includes a ring-like portion surrounding a transparent cover and in which a ring-like groove opened to an outer periphery of the ring-like portion is formed at the ring-like portion, a rotary bezel which includes a fitting portion rotatably fitted to the outer periphery of the ring-like portion and arranged to the case body and in which the fitting portion is formed with a guide groove opened to an inner periphery of the fitting portion and opposed to the ring-like groove, at least one piece of an operating screw rotatably attached to the fitting portion by being inserted to the guide groove from an outer side of the rotary bezel, and a holding member connected to a front end portion of the operating screw by permitting rotation of the operating screw, and moved over to a holding position arranged over to the ring-like groove and the guide groove for preventing the rotary bezel from being detached and a release position of being fit into the guide groove by rotating the operating screw.

In the invention, the case body and the rotary bezel can be formed by a metal of stainless steel, titanium or the like or a hard synthetic resin or the like. In the invention, a sectional shape of the ring-like groove of the case body and a sectional shape of the guide groove of the rotary bezel can be constituted by a channel-like shape, a semicircular shape, a trapezoidal shape or the like. In the invention, at least one of the guide groove may be provided, and a plurality thereof is preferable. Further, the one guide groove includes a mode of being provided only at one portion in a peripheral direction of the fitting portion other than that the guide groove is constituted by a ring-like shape. Further, the guide groove in the mode of one or more of the guide grooves to be constructed by a constitution of being gradually widened in the peripheral direction of the fitting portion in accordance with proceeding to an opening of the guide groove opened at an inner peripheral face of the fitting portion from the innermost face, or may be constructed by a constitution in which an area of the innermost face and an area of the opening are the same without being widened in this way.

In the invention, when one or more of guide grooves other than in a ring-like shape are provided at the fitting portion, the operating screws are used in accordance with a number of the guide grooves. Although when the guide groove is constituted by the ring-like shape, one piece of the operating screw can be used, a plurality of pieces of operating screws may be used and these may be arranged at intervals, preferably, at equal intervals along the peripheral direction of the fitting portion.

In the invention, the holding member can be formed by a shape in correspondence with a shape of a ring-like groove of the case body or a shape of the guide groove of the rotary bezel. Further, the holding member can be formed by a metal of stainless steel, titanium or the like or a hard synthetic resin or the like. Along therewith, the holding member may be formed by selecting a material having a small friction resistance with a material forming the case body, for example, when the holding member is formed by a ferrous material in a case in which the case body is made of titanium, the constitution is preferable in that wear of the ring-like groove in accordance with an operation of rotating the rotary bezel can be restrained.

In the invention, that the operating screw is attached rotatably to the fitting portion includes a case in which a screw shaft portion of the operating screw is screwed and attached to a screw hole provided at the fitting portion by penetrating the screw hole. Otherwise, there is also included a mode in which the operating screw includes a round shaft portion on a head portion side and a front end portion comprising a screw portion continuous to the screw portion, the round shaft portion of the operating screw is rotatably penetrated to a round hole provided at the fitting portion to communicate with the guide groove, the operating screw is held so as not to be moved in an axial direction by drawout preventing means of a ring-like projected portion projected to, for example, an outer periphery of the round shaft portion and engaged with the innermost face of the guide groove (further, the ring-like projected portion can be inserted to the round hole by press-fitting the operating screw to the round hole), further, a screw hole extended in a horizontal direction is provided at the holding member prevented from being rotated by the guide groove, and by screwing the front end portion comprising the screw portion of the operating screw to the screw hole, the operating screw is rotatably attached to the fitting portion.

In the invention, various connection modes can be adopted other than an example explained below by an embodiment in connecting the holding member to the front end portion of the screw by permitting rotation of the operating screw. For example, when the operating screw is rotatably attached to the fitting portion by being screwed, a round horizontal hole penetrating the holding member in the horizontal direction may be provided at the holding member, a round shaft portion constituting a front end portion of the operating screw may be penetrated to the horizontal hole, and by providing drawout preventing means of a stop ring or the like at an outer periphery of the shaft portion, the holding member may be rotatably connected to the front end portion of the operating screw. Or, when the operating screw is attached rotatably to the fitting portion without being screwed, a screw hole extended in a horizontal direction may be provided at the holding member prevented from being rotated by the guide groove, and by screwing the front end portion comprising the screw portion of the operating screw to the screw hole, the holding member may be connected rotatably to the front end portion of the operating screw.

In accordance with one aspect of the invention, in order to detach the rotary bezel from the case body, by operating to rotate the operating screw in, for example, a loosening direction such that the holding member is moved in a direction of being drawn out from the ring-like groove of the case body, after making the holding member fit into the guide groove of the rotary bezel to be arranged at the release position, the rotary bezel can be drawn to be detached to the upper side of the case body. Further, in case of integration, in a state in which the holding member is fit into the guide groove of the rotary bezel, after fitting the rotary bezel to the ring-like portion of the case body, by moving the holding member in a direction of being projected from the guide groove by operating to rotate the operating screw in, for example, a fastening direction, the holding member may be arranged at the holding portion at which a portion thereof is inserted to the ring-like groove of the case body. Thereby, the holding member is caught by the ring-like groove of the case body and the rotary bezel is attached to be held by the case body so as not to be drawn to be detached to the upper side. After finishing the integration, when the rotary bezel receives a rotational operating force, a position of the holding member relative to the peripheral direction of the ring-like groove of the case body is changed and the rotary bezel is rotated to an arbitrary rotational position.

In accordance with another aspect of the invention, the holding member for preventing detachment of the rotary bezel from the case body is supported by the rotary bezel and is not arranged on an outer side of the rotary bezel. Therefore, the holding member or the like does not hamper the operation of rotating the rotary bezel. Furthermore, the ring-like groove of the case body is covered to be concealed by the rotary bezel, and the total of the outer peripheral face of the fitting portion of the rotary bezel is exposed, and therefore, the thickness of the bezel portion touched by the finger of the user in operating to rotate the rotary bezel is ensured to be large and the finger is easy to be caught thereby.

Further, as described above, the total of the outer peripheral face of the fitting portion of the rotary bezel is exposed, and therefore, the constitution is advantageous in designing the rotary bezel. In addition thereto, the holding member which is not arranged on the outer side of the rotary bezel does not constitute a hindrance when the rotary bezel is enlarged. Therefore, the large-diameter formation of the rotary bezel can be achieved without enlarging the case body, therefore, a restriction of the total of the timepiece in view of design is inconsiderable.

In the preferable mode of the invention, the ring-like groove and the guide groove respectively include guide faces opposed to each other in an up and down direction and in parallel with each other and the holding member includes upper and lower faces in parallel with each other guided by the guide faces. In the invention, the innermost faces of the ring-like groove and the guide groove over the up and down guide faces may be bent or may be constituted by a state orthogonal to the guide face.

In the mode of the invention, a clearance of fitting in the up and down direction between the ring-like groove and the holding member remains unchanged regardless of a degree of a depth of fitting the holding member to the ring-like groove of the case body. Therefore, even when the fitting depth is assumedly brought into a shallow state, the rotary bezel can be held such that the rotary bezel is not rattled considerably in the up and down direction.

In the preferable mode of the invention, the holding member includes a vertical hole or a groove penetrating a center portion of the member in the up and down direction, and a horizontal hole in a circular shape communicated with the vertical hole or the groove at a center portion in a height direction of the holding member, a front end portion of the operating screw is formed by a fitting shaft portion attached with a head slenderer than a screw shaft portion of the operating screw, and the fitting shaft portion is rotatably fitted to the horizontal hole and is prevented from being drawn from the horizontal hole by the head.

According to the mode of the invention, a part for preventing the holding member from being detached from the operating screw is not needed and an integration of connecting the holding member and the operating screw can be carried out by time and labor of only penetrating the fitting shaft portion attached with the head to the horizontal hole. Further, the head of the fitting shaft portion in correspondence with a part for preventing the holding member from being detached from the operating screw is contained in the vertical hole of the holding member as described above, and therefore, it is not necessary to deeply form the ring-like groove in consideration of the part. Therefore, since the ring-like groove can be made shallow, the fitting portion of the case body formed with the ring-like groove can be prevented from having a large diameter in view of maintaining a wall thickness of achieving a strength necessary therefor.

In a preferable mode of the invention, the guide groove is formed in a ring-like shape.

According to the mode of the invention, the guide groove opened to an inner periphery of the rotary bezel can simply be formed.

In a preferable mode of the invention, the head portion of the operating screw is projected from an outer peripheral face of the fitting portion in a state of arranging the holding member at the holding position. In the invention, it is preferable to constitute the head portion of the operating screw in a semi-spherical shape, further, when projected portions in a semi-spherical shape projected integrally from the outer peripheral face are provided at the fitting portion at intervals, and the head portion of the operating screw is disposed in the alignment of the projected portions, the finger is further easy to be caught thereby, and therefore, the constitution is preferable.

In the mode of the invention, the head portion of the operating screw can be utilized as a portion for catching the finger of the user when the rotary bezel is operated to rotate.

According to the invention, the rotary bezel can be attached and detached without being accompanied by deformation of the rotary bezel and the case body, further, in addition to the fact that the finger is easy to be caught by the rotary bezel, there is not a member of hampering the rotational operation at a surrounding of the rotary bezel, and therefore, the rotation operability of the rotary bezel can be promoted and there is not a member around the rotary bezel, and therefore, a timepiece without bringing about large-sized formation of the case body when the rotary bezel is enlarged in view of design can be provided.

DESCRIPTION OF PREFERRED EMBODIMENTS

A first embodiment of the invention will be explained in reference to FIG. 1 through FIG. 6.

Figure 1:
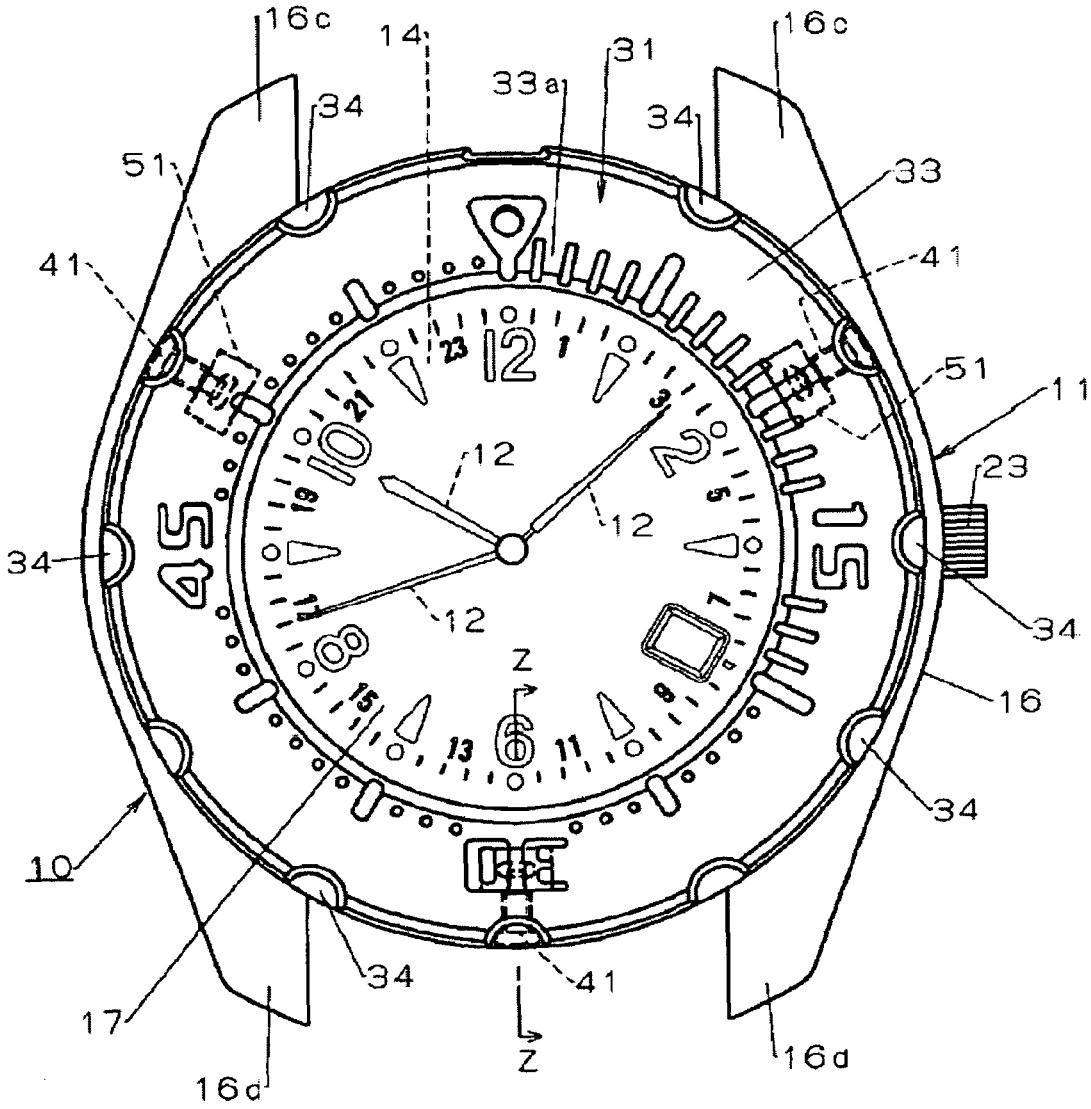
FIG. 1 is a plane view showing a wristwatch according to a first embodiment of the invention.
Figure 3:
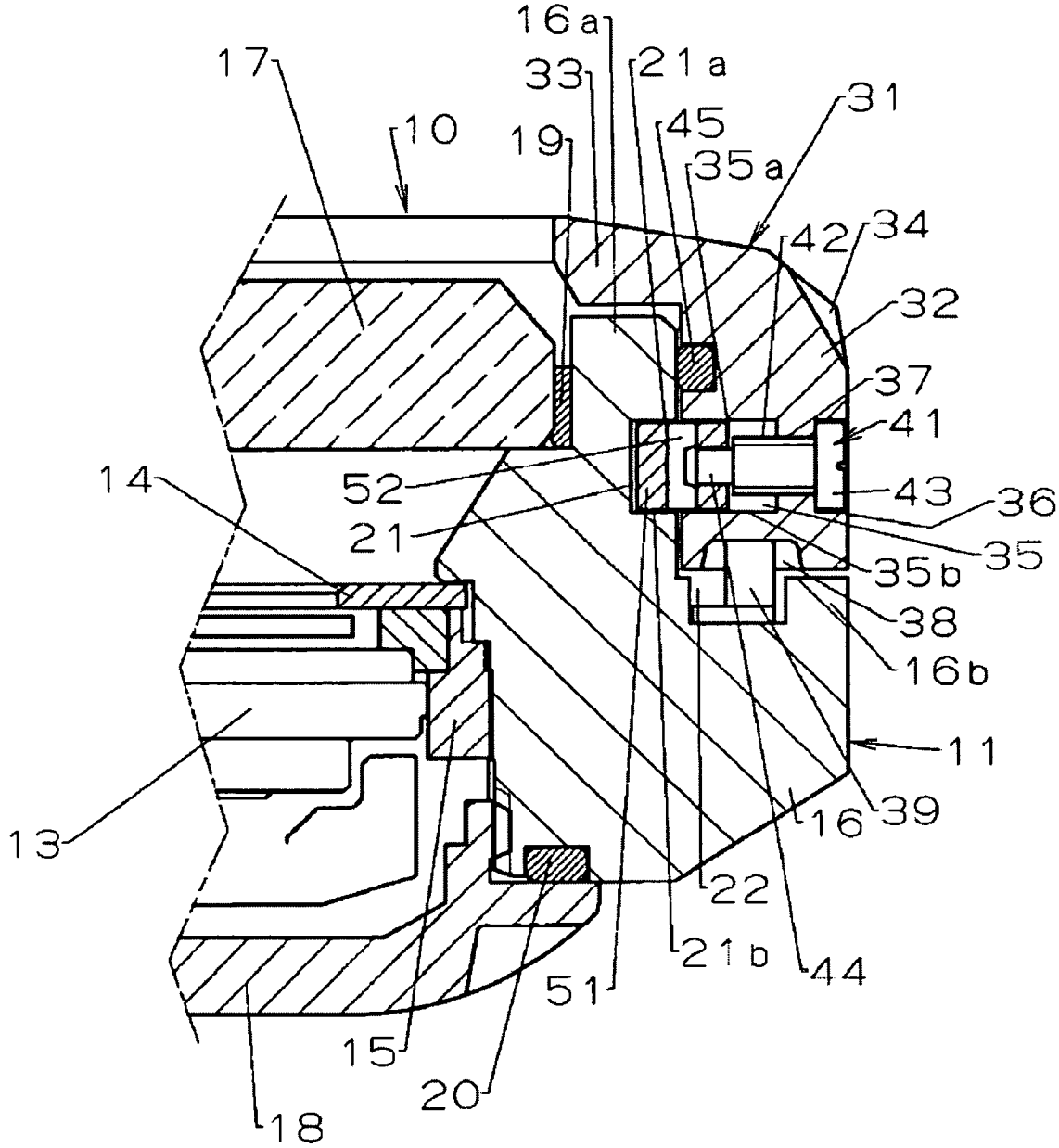
FIG. 3 is a sectional view taken along a line Z-Z in FIG. 1 showing a state of attaching a rotary bezel provided to the wristwatch of FIG. 1 to be held by a case body.
Figure 4:
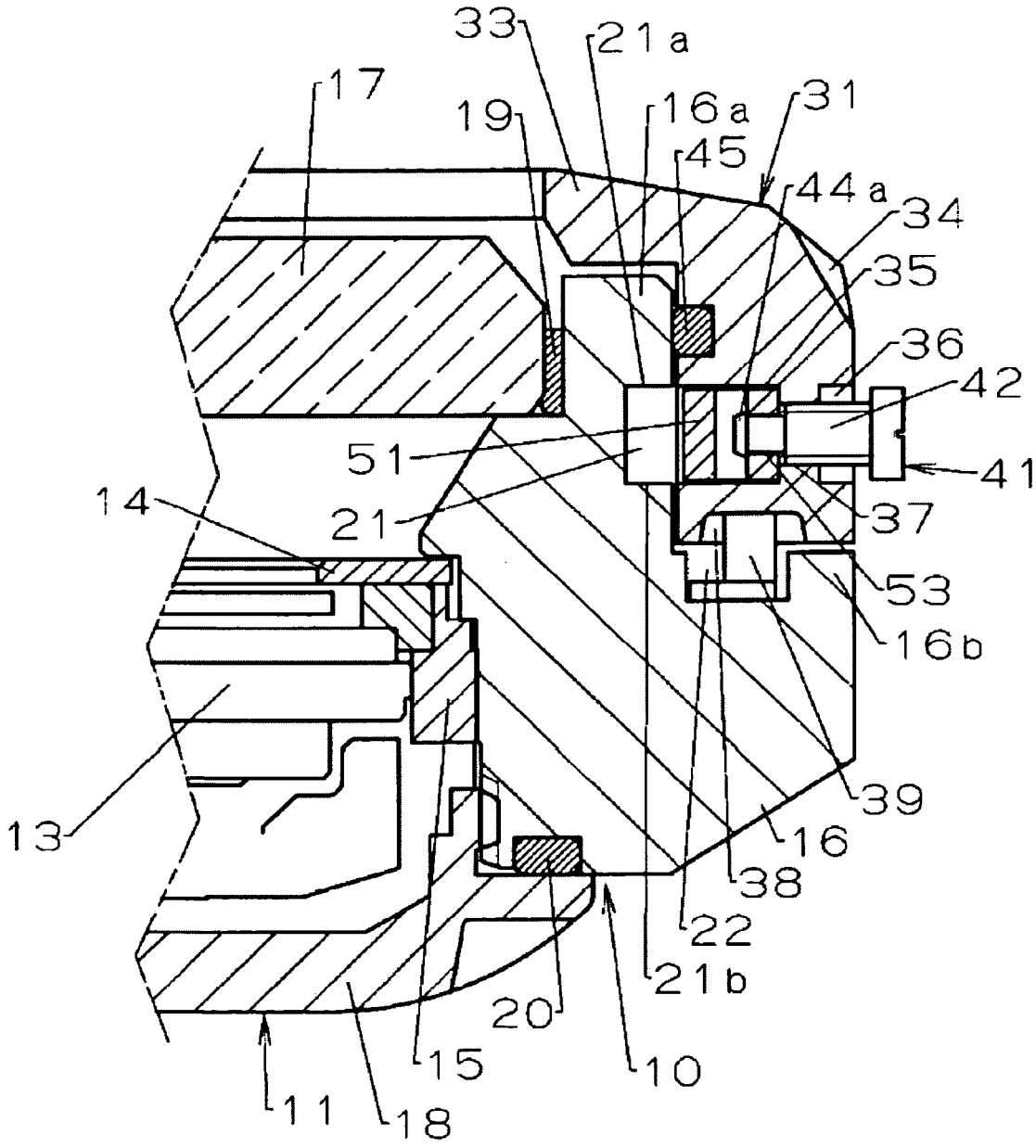
FIG. 4 is a sectional view taken along the line Z-Z in FIG. 1 showing a state of releasing the rotary bezel provided to the wristwatch of FIG. 1 from being held by the case body.

In FIG. 1, notation 10 designates a timepiece, for example, a portable timepiece, specifically, a wristwatch. A timepiece movement 13 for driving an indicating hand 12 (refer to FIG. 1), a dial 14 attached to the timepiece movement 13, and a frame-like member 15 for holding the timepiece movement 13 at a timepiece exterior assembly 11 and the like as shown by FIG. 3 and FIG. 4 are contained in the timepiece exterior assembly 11 provided to the wristwatch 10. The indicating hand 12 and the dial 14 constitute a timepiece display portion.

As shown by FIG. 3 and FIG. 4, the timepiece exterior assembly 11 is formed by attaching a cover glass 17 as a transparent cover and a case back 18 to a case body 16 made in a ring or ring-like shape by a metal. Further, the transparent cover can also be formed of a transparent synthetic resin. A front side of the case body 16 is integrally formed with a ring-like portion 16*a* in a circular shape in a plane view thereof, and the cover glass 17 is mounted to an inner side of the ring-like portion 16*a* in a circular shape in a plane view thereof, and the cover glass 17 is mounted to an inner side of the ring-like portion 16*a* in a liquid tight manner. Therefore, the ring-like portion 16*a* is provided to surround the cover glass 17. Further, notation 19 in FIG. 3 and FIG. 4 designates a waterproof packing in a ring-like shape sandwiched by the ring-like portion 16*a* and the cover glass 17. The indicating hand 12 and the dial 14 can visually be recognized through the cover glass 17. The case back 18 is made of a metal and screwed detachably to a back face side of the case body 16. Further, notation 20 in FIG. 3 and FIG. 4 designates a waterproof packing in a ring-like shape sandwiched by the case body 16 and the case back 18.

Figure 2:
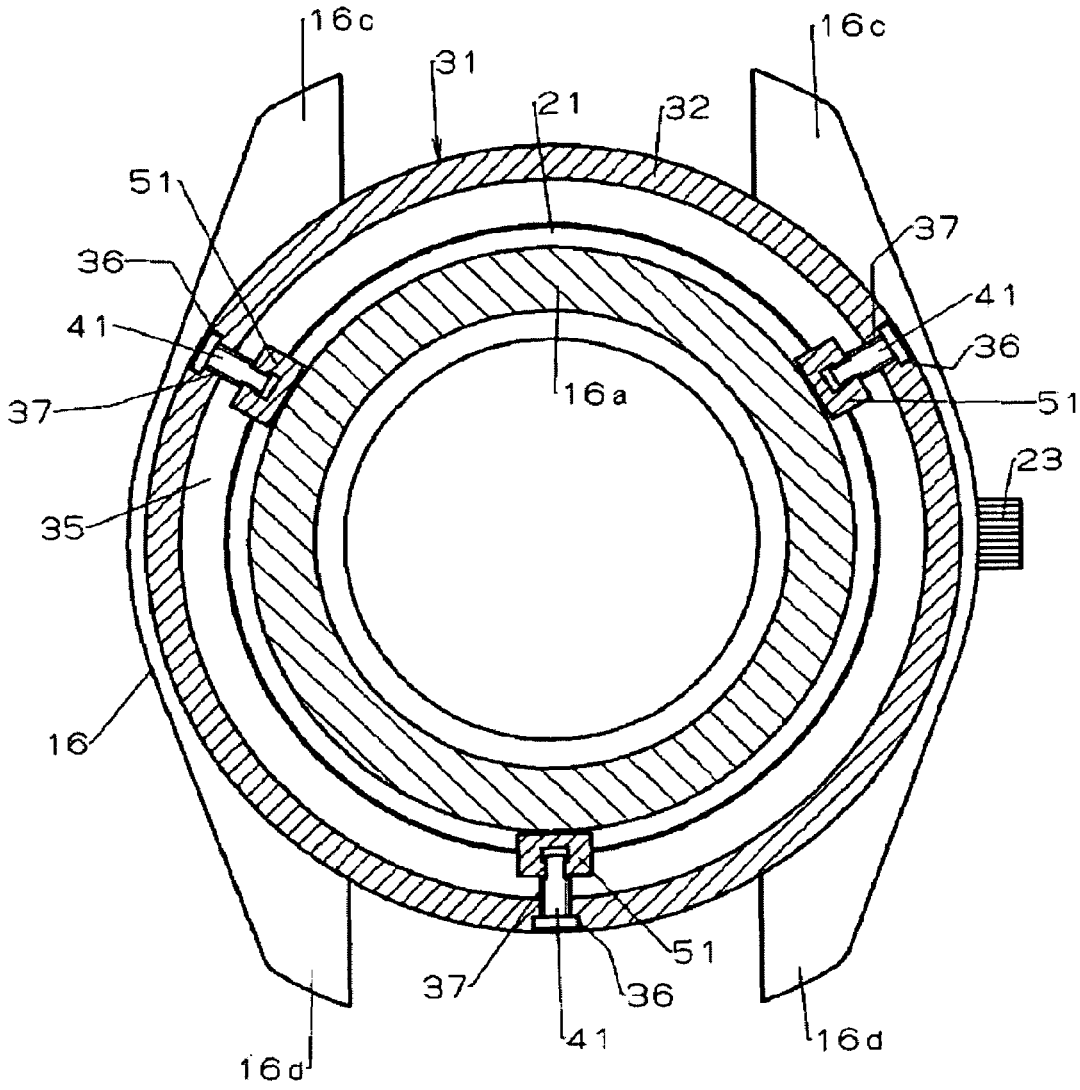
FIG. 2 is a cross-sectional plane view showing the wristwatch of FIG. 1.

As shown by FIG. 2 through FIG. 4, a ring or ring-like groove 21 is formed at the ring-like portion 16*a* of the case body 16. The ring-like groove 21 is opened to an outer periphery of the ring-like portion 16*a*. A sectional shape of the ring-like groove 21 is a channel-like shape, therefore, the ring-like groove 21 includes guide faces 21*a* and 21*b* in a horizontal shape opposed to each other in an up and down direction and in parallel with each other.

The case body 16 includes a shoulder portion 16*b* in a ring-like shape integral with a root of the ring-like portion 16*a* and continuously expanded to an outer side. The shoulder portion 16*b* is formed with a recess groove 22 opened from an upper face thereof. The recess groove 22 is constituted by a ring-like shape and provided concentrically with the ring-like portion 16*a*.

Notations 16*a* and 16*d* in FIG. 1 and FIG. 2 designate a pair of tube feet integral with the case body 16. One pair of the tube feet 16*c* opposed to each other in the 3 o'clock-9 o'clock direction are provided on the 12 o'clock side. The other pair of the tube feet 16*d* opposed to each other similarly in the 3 o'clock-9 o'clock direction are provided on the 6 o'clock side. A timepiece strap, not illustrated, is attached to the tube feet 16*c*. Further, notation 23 in FIG. 1 and FIG. 2 designates a crown.

As shown by FIG. 1, the timepiece exterior assembly 11 includes a rotary bezel 31 in a ring or ring-like shape. The rotary bezel 31 is made of, for example, a metal and includes a fitting portion 32 and a cover portion 33 integral therewith as shown by FIG. 3 and FIG. 4. The cover portion 33 can be formed separately from the fitting portion 32 to be connected to the fitting portion 32.

The fitting portion 32 of the rotary bezel 31 constitutes a shape of a short cylinder having a height substantially the same as, for example, a height of the ring-like portion 16*a*, and fitted to an outer periphery of the ring-like portion 16*a* attachably and detachably. An outer diameter of the fitting portion 32 is substantially the same as, for example, an outer diameter of the shoulder portion 16*b* of the case body 16, and therefore, an outer peripheral face of the fitting portion 32 is provided to be continuous to an outer peripheral face of the shoulder portion 16*b* to be flush therewith on an upper side.

The cover portion 33 is folded to bend from an upper end of the fitting portion 32 to an inner side to cover an upper end face of the ring-like portion 16*a*. At a corner made by the outer peripheral face of the fitting portion 32 and a surface of the cover portion 33, as shown by FIG. 1, grooves 34 are formed at constant intervals along a peripheral direction of the rotary bezel 31. The respective grooves 34 are provided to prevent the finger of a user from slipping when the rotary bezel 31 is operated to rotate. Further, the grooves 34 can also be provided so as to extend in an up and down direction over the whole thickness of the outer peripheral face of the fitting portion 32.

As shown by FIG. 1, the surface of the cover portion 33 is provided with a display 33*a* for indicating a rotational position of a numeral, a graduation or the like. The display 33*a* can be matched to an arbitrary position related to a display of the dial 14 by operating to rotate the rotary bezel 31. Therefore, by matching the display 33*a* to a specific indicating hand angle of, for example, competition start time, start of diving or the like, a time period elapsed from the competition start time point or a time period elapsed from the start of diving can be known.

Next, an explanation will be given of holding means for preventing the rotary bezel 31 from being detached from the case body 16 while permitting the rotational operation of the rotary bezel 31. The holding means includes the ring-like groove 21, a plurality, for example, 3 pieces of operating screws 41 and holding members 51 connected to the operating screws 41.

In details, the fitting portion 32 of the rotary bezel 31 includes a guide groove 35 opened from an inner peripheral face of the fitting portion 32. As shown by FIG. 2, the guide groove 35 is formed in a ring-like shape and is provided at a height the same as that of the ring-like groove 21. Therefore, the guide groove 35 and the ring-like groove 21 are provided to communicate with each other by making openings thereof opposed to each other.

The guide groove 35 includes guide faces 35*a* and 35*b* in a horizontal shape opposed to each other in the up and down direction and in parallel with each other similar to the ring-like groove 21. The constitution of making the guide groove 35 in the ring-like shape is preferable in that workability is excellent when the guide groove 35 is worked by machining at the rotary bezel 31.

The fitting portion 32 is provided with recess portions 36 and screw holes 37 of numbers the same as that of the operating screws 41. The recess portion 36 is constituted by a round hole, provided at a height the same as that of the guide groove 35 in correspondence therewith and is opened to an outer peripheral face of the fitting portion 32. The screw hole 37 is provided with a diameter smaller than that of the recess portion 36 and communicates the guide groove 35 and the recess portion 36. As shown by FIG. 2, the recess portions 36 and the screw holes 37 both ends of which are opened to center portions thereof and innermost faces of the guide groove 35 are provided at intervals of, for example, 120 degrees.

Figure 5:
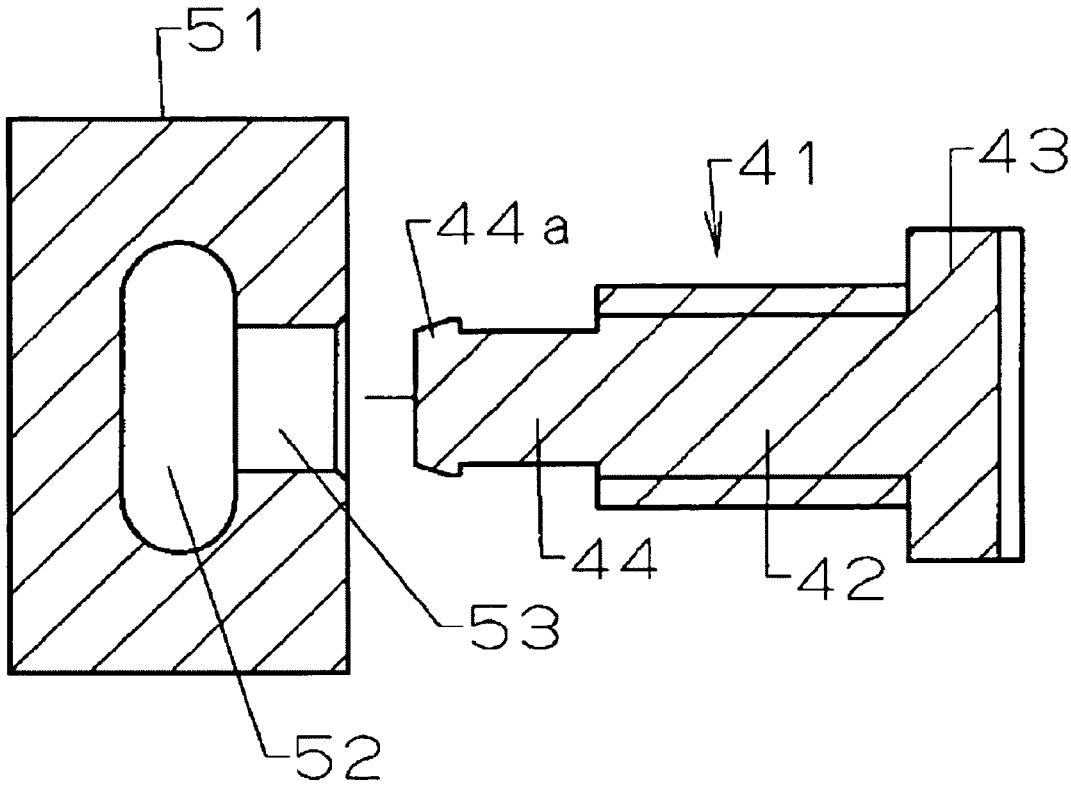
FIG. 5 is a sectional view showing a relationship of a holding member and an operating screw provided to the wristwatch of FIG. 1.

As shown by FIG. 3 through FIG. 5, the operating screw 41 is formed by providing a head portion 43 at one end portion of a screw shaft portion 42 and providing a fitting shaft portion 44 attached with a head 44*a* constituting a front end portion of the operating screw 41 at other end portion of the screw shaft portion 42. A total of the head portion 43 is made by a size of being able to be contained in the recess portion 36. The fitting shaft portion 44 is formed to be slenderer than the screw shaft portion 42 and the head 44*a* constitutes a converging shape.

The operating screw 41 is screwed to the screw hole 37 from an outer side of the fitting portion 32 of the rotary bezel 31 and is attached movably along a diameter direction of the rotary bezel 31. As shown by FIG. 3, a total of the head portion 43 is fit in the recess portion 36 in a state of screwing the operating screw 41 to butt to an innermost face of the recess portion 36.

Figure 6:
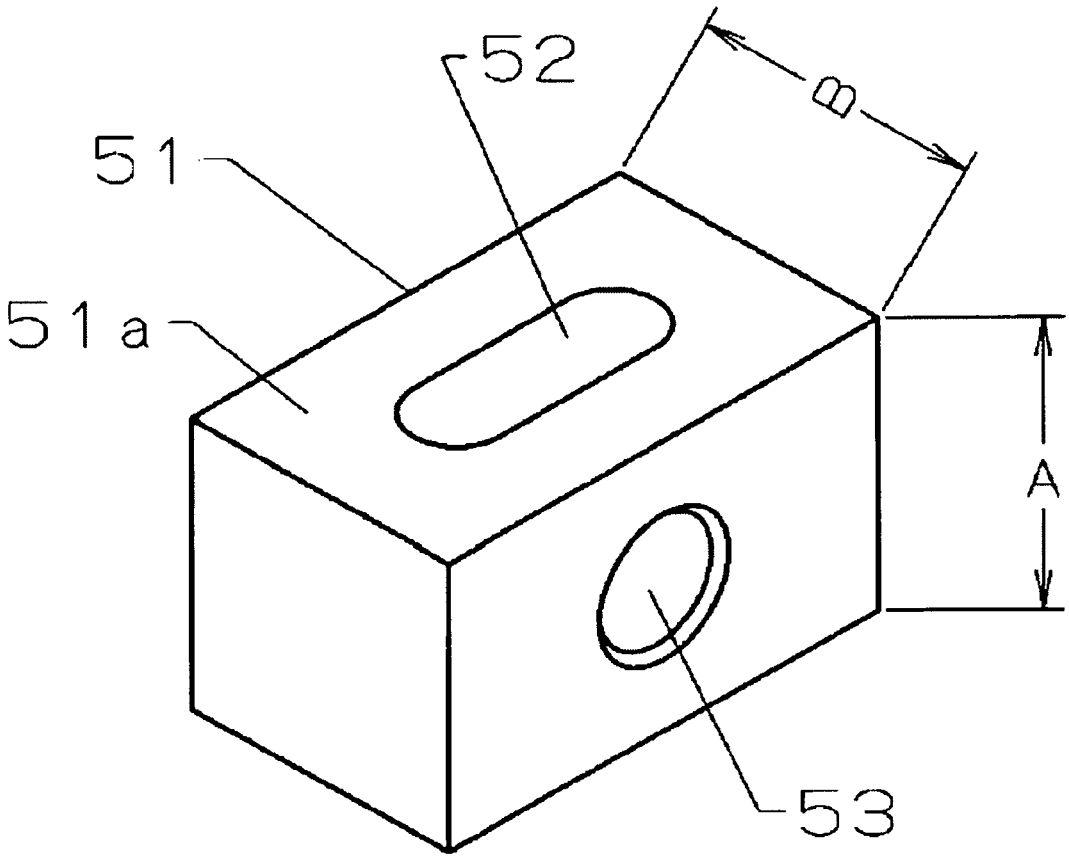
FIG. 6 is a perspective view showing the holding member provided to the wristwatch of FIG. 1.

As shown by FIG. 6, the holding member 51 is formed of a block of a metal constituting, for example, a shape of a parallelepiped. A height dimension A of the holding member 51 is substantially equal to a dimension between the guide faces 21*a* and 21*b* of the ring-like groove 21 and a dimension between the guide faces 35*a* and 35*b* of the guide groove 35. A width B of the holding member 51 is equal to or smaller than a depth dimension of the guide groove 35. Therefore, a total of the holding member 51 is made by a size capable of being fit into the guide groove 35.

As shown by FIG. 5 and FIG. 6, the holding member 51 includes a vertical hole 52 and a horizontal hole 53. As shown by FIG. 3 and FIG. 4, the vertical hole 52 is penetrated in the up and down direction at a center portion of the holding member 51 and is made to a size capable of containing the head 44*a*. The horizontal hole 53 is communicated with the vertical hole 52 at a center portion in a height direction of the holding member 51. The horizontal hole 53 is a hole in a circular shape and a diameter thereof is larger than a portion of the fitting shaft portion 44 excluding the head 44*a* and smaller than a diameter of the head 44*a*. Further, in place of the vertical hole 52, a groove penetrated in the up and down direction can also be constituted.

The holding member 51 is attached to the rotary bezel 31 by the following procedure.

First, the operating screw 41 is screwed to the screw hole 37 of the rotary bezel 31 to project the fitting shaft portion 44 into the guide groove 35.

Next, the horizontal hole 53 is fitted to the fitting shaft portion 44 while inserting the holding member 51 to the guide groove 35 by directing the horizontal hole 53 to a lower side. Thereby, the head 44*a* of the fitting shaft portion 44 is press-fit to the horizontal hole 53 while being accompanied by flexible deformation.

Further, at a time point of passing the head 44*a* through the horizontal hole 53 to be arranged at the inside of the vertical hole 52, the fitting shaft portion 44 is rotatably fitted to the horizontal hole 53 and integration is carried out such that the fitting shaft portion 44 is not drawn from the horizontal hole 53 by recovering the head 44*a*. In the integrated state, upper and lower faces (only upper face is shown by notation 51*a* in FIG. 6) constituting a horizontal shape of the holding member 51 are slidably brought into contact with the guide faces 35*a* and 35*b* of the guide groove 35.

Therefore, the rotary bezel 31 is attached to the case body 16 by the following procedure. First, by operating to rotate the operating screw 41 in a loosening direction, the holding member 51 is moved along with the operating screw 41 to slide at the guide faces 35*a* and 35*b* of the guide groove 35, and as shown by FIG. 3, the holding member 51 is arranged at a position of pulling the total of the holding member 51 to fit into the guide groove 35, that is, at a release position.

Next, the fitting portion 32 of the rotary bezel 31 is fitted to cover the ring-like portion 16*a* of the case body 16.

Thereafter, by screwing the operating screw 41 in a fastening direction, the holding member 51 is moved along with the operating screw 41 from the release position to the ring-like portion 16*a* by constituting a guide by the guide faces 35*a* and 35*b*. Thereby, as shown by FIG. 4, the holding member 51 is arranged at a holding position at which a portion (front end side portion) of the holding member 51 is inserted to the ring-like groove 21, the upper face 51*a* of the holding member 51 is slidably brought into contact with the guide face 21*a* of the ring-like wall 21 and a lower face of the holding member 51 is slidably brought into contact with the guide face 21*b* of the ring-like wall 21.

At the holding position, the holding member 51 is arranged over the ring-like groove 21 and the guide groove 35. Therefore, by catching the holding member 51 by the ring-like groove 21, the rotary bezel 31 is attached to and held by the case body 16 in a state of preventing the rotary bezel 31 from being directed to an upper side relative to the ring-like portion 16*a*.

Further, in order to detach the rotary bezel 31 from the case body 16 in carrying out maintenance around the rotary bezel 31 or the like, the detachment may be carried out by a procedure reverse to that of integration explained above.

As described above, the rotary bezel 31 can be detached from the case body 16 by moving the holding member 51 to the release position by rotating the operating screw 41 attached rotatably to the rotary bezel 31. Therefore, an excessively large external force is not exerted to the rotary bezel 31 and the case body 16, and therefore, the rotary bezel 31 and the case body 16 are not deformed. Further, the same goes also when the rotary bezel 31 is attached to the case body 16.

A number of engaging grooves 38 (only one is illustrated) are provided at a lower face of the fitting portion 32 of the rotary bezel 31 opposed to an upper face of the shoulder portion 16*b* of the case body 16. The engaging grooves 38 are formed continuously along a peripheral direction of the fitting portion 32 and opposed to the recess groove 22. The recess groove 22 is attached with a leaf spring 39 for urging the rotary bezel 31 in an upper direction, and the leaf spring 39 is engageably and disengageably engaged with the engaging groove 38 by its own elastic force. The leaf spring 39 is engaged with and disengaged from the engaging groove 38 in accordance with rotating the rotary bezel 31, thereby, a click feeling is given to the operation of rotating the rotary bezel 31.

Notation 45 in FIG. 3 and FIG. 4 designates a packing disposed between the cover portion 33 and the guide groove 35 and attached to an inner peripheral face of the fitting portion 32. The packing 45 is formed in a ring-like shape and is made of a soft synthetic rubber or the like and is provided by bringing an inner peripheral face thereof into close contact with an outer peripheral face of the ring-like portion 16*a* at a position upward from the ring-like groove 21.

Thereby, a pertinent resistance is provided to rotation of the rotary bezel 31 and wear between the outer peripheral face of the ring-like portion 16*a* and the inner peripheral face of the fitting portion 32 is prevented. Further, the leaf spring 39 and the packing 45 are parts constituting an object of maintenance. Further, by the packing 45, a foreign matter of sand particles, dust or the like is restrained from invading the ring-like groove 21 of the holding means from the front side of the wristwatch 10, and therefore, the rotation of the rotary bezel 31 is not hindered.

According to the wristwatch 10 having the above-described constitution, the holding member 51 for preventing the rotary bezel 31 from being detached from the case body 16 and the operating screw 41 for moving the holding member 51 are supported by the rotary bezel 31. Therefore, when an operator operates to rotate the rotary bezel 31, the operation of rotating the rotary bezel 31 is not hindered by constituting a stopper by the holding member 51 or the like.

Furthermore, the rotary bezel 31 covers to conceal the ring-like groove 21 of the case body 16 and a total of an outer peripheral face of the fitting portion 32 of the rotary bezel 31 is exposed. Therefore, a thickness of the bezel portion touched by the finger of a user when operating to rotate the rotary bezel 31 is ensured to be large and the finger is easy to be caught thereby. Therefore, the rotation operability of the rotary bezel 31 can be promoted.

When the rotary bezel 31 is operated to rotate and the position of the holding member 51 in the peripheral direction of the ring-like groove 21 is changed, the holding member 51 slides on the guide faces 21*a* and 21*b* along the peripheral direction of the ring-like groove 21. In this case, the plurality of holding members 51 sliding on the ring-like groove 21 are arranged at equal intervals in the peripheral direction of the ring-like groove 21, and therefore, the rotary bezel 31 is not inclined and the rotation can be stabilized.

As described above, the fitting portion 32 of the rotary bezel 31 covers to conceal the ring-like groove 21 of the case body 16 and the total of the outer peripheral face of the fitting portion 32 is exposed. Thereby, the rotary bezel 31 can be designed including the exposed face, and therefore, the constitution is advantageous in view of design. In addition thereto, the holding member 51 for preventing detachment of the rotary bezel 31 from the case body 16 is not arranged on an outer side of the rotary bezel 31, and therefore, the holding member 51 does not constitute a hindrance in enlarging the rotary bezel 31. Thereby, large-diameter formation of the rotary bezel 31 can be achieved without enlarging the case body 16, and therefore, a restriction in view of design of a total of the wristwatch 10 is inconsiderable and a degree of freedom of design in view of design is high.

Further, the ring-like groove 21 of the case body 16 includes the guide faces 21*a* and 21*b* opposed to each other in the up and down direction and in parallel with each other, also the guide groove 35 includes the guide faces 35*a* and 35*b* opposed to each other in the up and down direction and in parallel with each other, and upper and lower faces of the holding member 51 are guided by the guide faces. Therefore, a clearance of fitting the ring-like groove 21 and the holding member 51 in the up and down direction remains unchanged regardless of a degree of a depth of fitting the holding member 51 to the ring-like groove 21. Therefore, even when the fitting depth is assumedly brought into a shallow state, the rotary bezel 31 can be held such that the rotary bezel 31 is not rattled considerably in the up and down direction, and therefore, rotation of the rotary bezel 31 can be stabilized.

Further, the holding member 51 and the operating screw 41 are connected while preventing the fitting shaft portion 44 from being drawn from the horizontal hole 53 by the head 44*a* of the fitting shaft portion 44 by rotatably fitting the fitting shaft portion 44 attached with the head 44*a* of the operating screw 41 to the horizontal hole 53 of the holding member 51, and therefore, a part of preventing the holding member 51 from being detached from the operating screw 41 is not needed. Along therewith, the holding member 51 and the operating screw 41 can be connected by time and labor of only penetrating the fitting shaft portion 44 to the horizontal hole 53. Therefore, a connection operability of the holding member 51 and the operating screw 41 is excellent.

Further, the head 44*a* of the fitting shaft portion 44 in correspondence with a part for preventing the holding member 51 from being detached from the operating screw 41 is contained in the vertical hole 52 of the holding member 51, and therefore, it is not necessary to deeply form the ring-like groove 21 in consideration of a thickness of the part for preventing the detachment or the like. Therefore, the ring-like portion 16*a* of the case body 16 formed with the ring-like groove 21 can be prevented from having a large diameter when the ring-like groove 21 can be made shallow in view of maintaining a wall thickness of achieving a strength necessary therefor.

Figure 7:
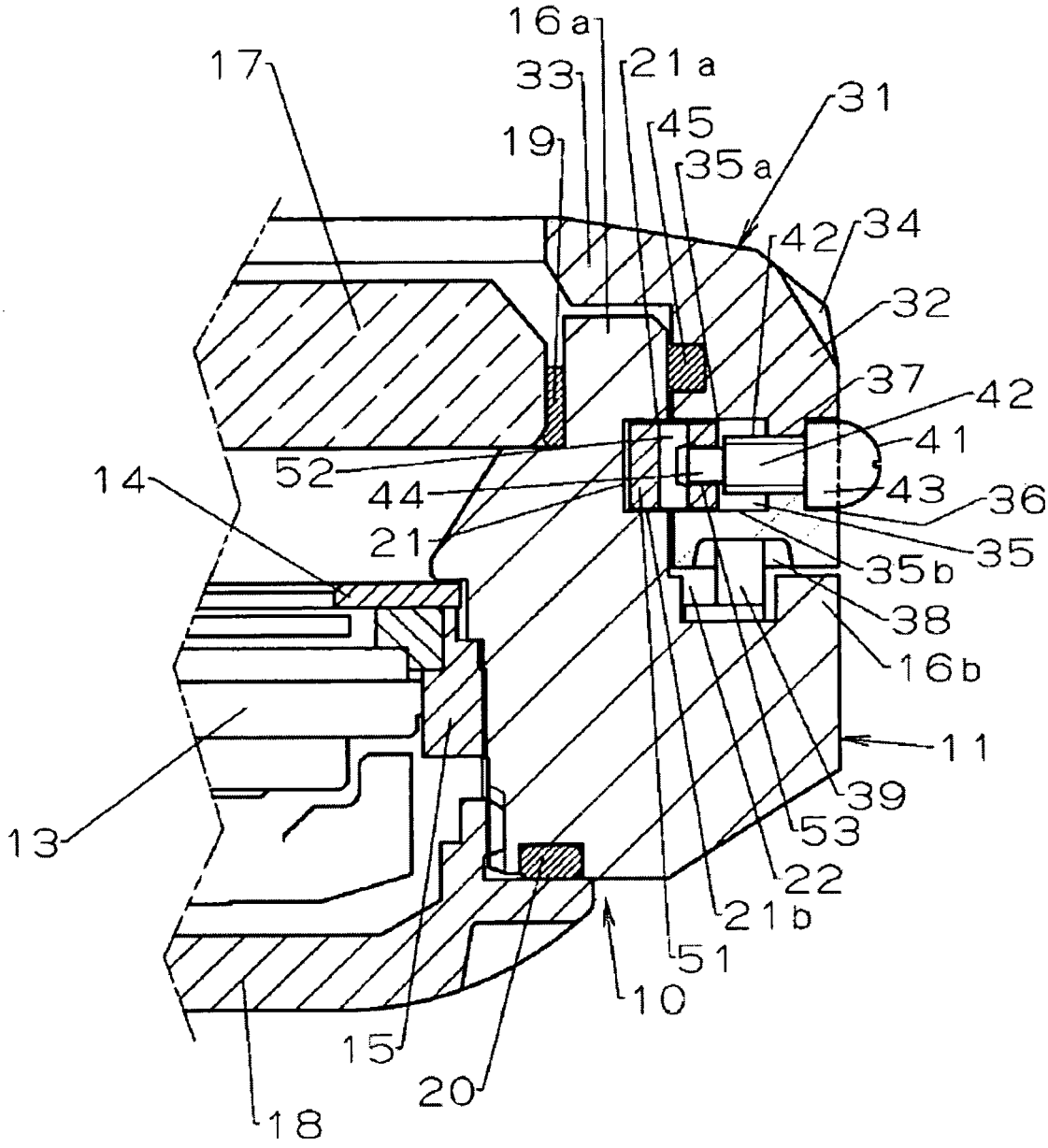
FIG. 7 is a sectional view in correspondence with FIG. 3 showing a wristwatch according to a second embodiment of the invention.

A second embodiment of the invention will be explained in reference to FIG. 7. The second embodiment is the same as the first embodiment except for an item explained below, and therefore, the constitution the same as that of the first embodiment is attached with a notation the same as that of the first embodiment and an explanation thereof will be omitted.

According to the second embodiment, the head portion 43 of the operating screw 41 is projected from the outer peripheral face of the fitting portion 32 even in the state of arranging the holding member 51 to the holding position. Further, the head portion 43 is formed in, for example, a semispherical shape. The second embodiment is the same as the first embodiment except the item explained above.

Therefore, also the wristwatch 10 of the second embodiment can resolve the problem of the invention by the reason already explained in the first embodiment. Further, the head portion 43 of the operating screw 41 projected from the outer peripheral face of the fitting portion 32 can be utilized as a portion of touching the finger of the user in operating to rotate the rotary bezel 31, and therefore, the constitution is effective in further promoting the rotation operability of the rotary bezel 31.

What is claimed is:

1. A timepiece comprising:

a case body having a ring portion that surrounds a transparent cover, the ring portion having a ring groove formed therein that opens to an outer periphery of the ring portion;

a rotary bezel rotatably disposed on the case body and having a fitting portion rotatably fitted to the outer periphery of the ring portion, the fitting portion having a guide groove that opens to an inner periphery of the fitting portion and opposes the ring groove;

at least one operating screw screwed to the fitting portion from an outer side of the rotary bezel so that a front end portion of the operating screw extends into the guide groove; and a holding member connected to the front end portion of each operating screw so as to permit rotation of the operating screw relative to the holding member, wherein rotation of the operating screw in a tightening direction moves the holding member to a holding position in which the holding member extends into the ring groove to prevent the rotary bezel from being detached from the case body, and rotation of the operating screw in a loosening direction moves the holding member out of the ring groove to a release position in which the holding member extends into the guide groove to permit detachment of the rotary bezel from the case body.

2. The timepiece according to claim 1; wherein the ring groove and the guide groove respectively include guide faces opposed to each other in an up and down direction and in parallel with each other, and the holding member includes upper and lower faces in parallel with each other and guided by the guide faces.

3. The timepiece according to claim 1; wherein the holding member includes a vertical hole or a groove penetrating a center portion of the holding member in the up and down direction, and a horizontal hole in a circular shape communicated with the vertical hole or the groove at a center portion in a height direction of the holding member, the front end portion of each operating screw having a fitted shaft portion attached with a head slenderer than a screw shaft portion of the operating screw, and the fitting shaft portion is rotatably fitted to the horizontal hole and is prevented from being drawn from the horizontal hole by the head.

4. The timepiece according to claim 1; wherein the guide groove has a ring shape.

5. The timepiece according to claim 1; wherein a head portion of each operating screw projects from an outer peripheral face of the fitting portion when the holding member is in the holding position.

* * * * *